United States Patent [19]

Breining et al.

[11] 4,150,752

[45] Apr. 24, 1979

[54] DISPLAY RACK FOR EYEGLASSES

[75] Inventors: Grant F. Breining, York; Ronald C. Webb, Red Lion, both of Pa.

[73] Assignee: Dentsply Research & Development Corp., Milford, Del.

[21] Appl. No.: 905,836

[22] Filed: May 15, 1978

[51] Int. Cl.[2] ..... A47F 7/02

[52] U.S. Cl. ..... 211/13; 206/5; 211/2; 248/DIG. 2; 248/174

[58] Field of Search ..... 211/13, 2, 60 R, 60 A; 248/DIG. 2, 174, 459, 450; 206/5, 45.14

[56] References Cited

U.S. PATENT DOCUMENTS

| | | | |
|---|---|---|---|
| 1,446,450 | 2/1923 | Casey | 248/174 |
| 1,543,102 | 6/1925 | Fleischer | 248/174 X |
| 1,630,373 | 5/1927 | Combs | 211/13 X |
| 3,040,881 | 6/1962 | McNeill | 211/13 |
| 3,184,058 | 5/1965 | Crowther | 206/5 |
| 3,291,300 | 12/1966 | Rosen | 206/5 |
| 3,333,708 | 8/1967 | Leblanc et al. | 211/13 |
| 3,858,726 | 1/1975 | Rosenwein | 211/13 |
| 3,895,718 | 7/1975 | Seiller | 211/13 |

*Primary Examiner*—Roy D. Frazier
*Assistant Examiner*—Robert W. Gibson, Jr.
*Attorney, Agent, or Firm*—C. Hercus Just

[57] ABSTRACT

A multi-position display rack for eyeglasses comprising a frame that is triangular in cross-section and composed of panels connected along the edges, one corner of said frame having a narrow rib projecting outwardly therefrom and the outer edge of said rib having notches therein to receive nose bridges of eyeglass frames and the panels adjacent said rib having apertures therein to receive the temples of said frames. Several embodiments of frames are included, one being formed by folding a sheet of material along fold lines, and another being of rigid construction.

9 Claims, 12 Drawing Figures

Fig. 1
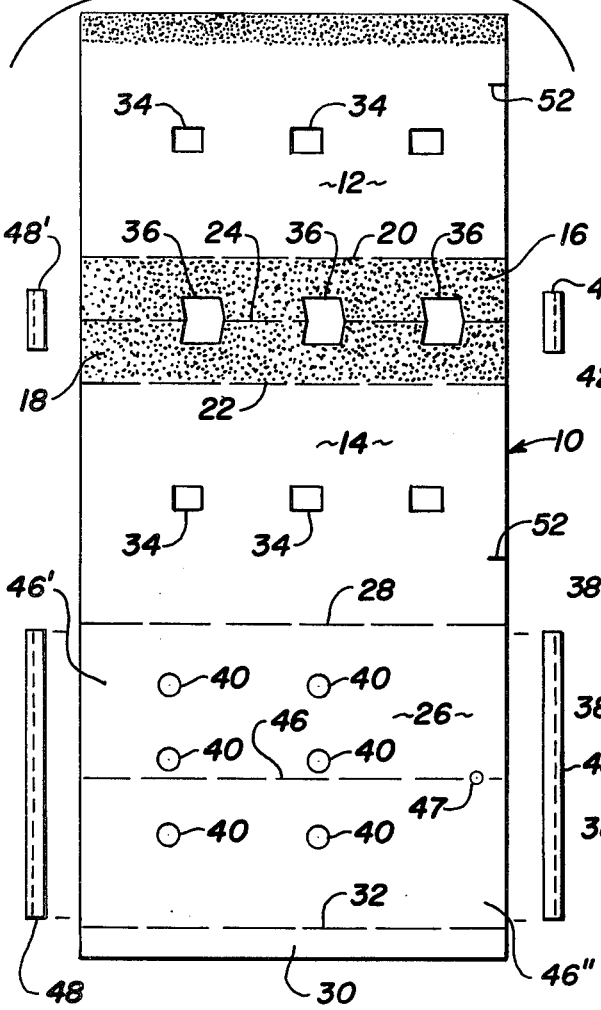
Fig. 2
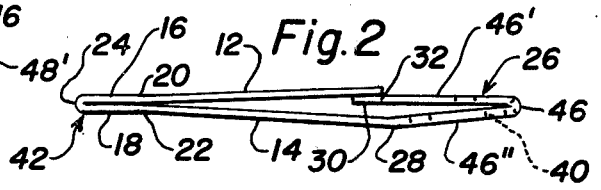
Fig. 3
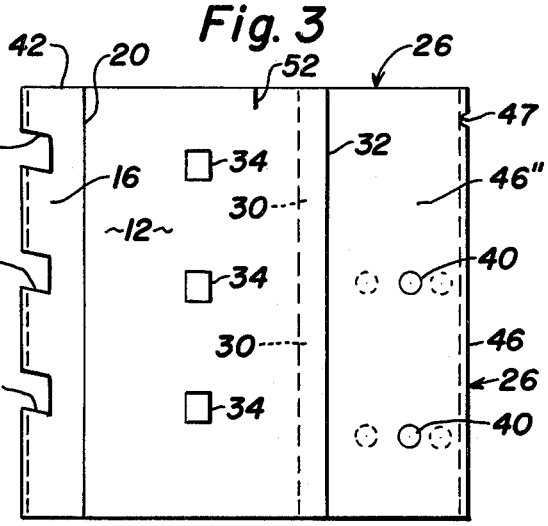
Fig. 5
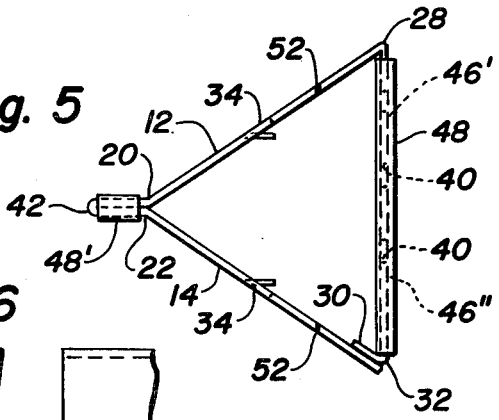
Fig. 6
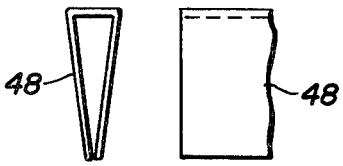
Fig. 7
Fig. 4
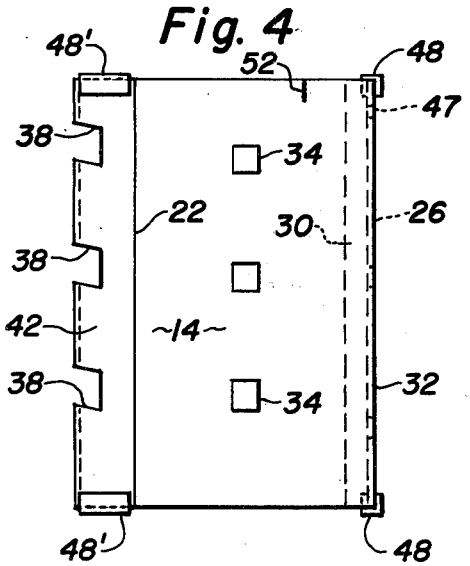

DISPLAY RACK FOR EYEGLASSES

BACKGROUND OF THE INVENTION

Display racks for eyeglasses have existed for many years and are used in various types of stores which dispense sunglasses and the same also are employed in opticians' offices and establishments for purposes of displaying eyeglasses in order that patients may select particularly the shapes and styles of frames they desire to be used in their eyeglasses which are being prepared for them by the optician. Many of the existing display racks are somewhat bulky in nature and require special types of cartons for shipping purposes. Exemplary of this type is the display stand comprising the subject matter of U.S. Pat. No. 3,895,718, in the name of Seiller, dated July 22, 1975. The display rack comprising the subject matter of U.S. Pat. No. 3,333,708, in the name of Leblanc et al, dated Aug. 1, 1967, also is in the same category.

Other forms of display racks and cards are of a generally flat nature and representative of this type are the racks shown in U.S. Pat. Nos. 3,040,881 to McNeill, dated June 26, 1962; No. 3,184,058 to Crowther, dated May 18, 1965; and No. 3,858,726 to Rosenwein, dated Jan. 7, 1975, said racks being somewhat in the nature of easels. U.S. Pat. No. 3,291,300 to Rosen, dated Dec. 13, 1966, is a sort of combination package and display device for eyeglasses.

Considering the fact that display racks and devices normally are given along with initial and reorder supplies of eyeglasses of various kinds to opticians and other stores where various types of eyeglasses, such as eyeglasses, are sold, it is preferable that display racks be as simple and inexpensive as possible, coupled with convenience of handling and setting up the same into operative position and preferably, at the same time, being attractive and effective in the holding of eyeglasses for display in convenient location. The present invention is directed to several embodiments of simple but efficient and serviceable type of eyeglass display rack embodying principles utilized in a different way from any of those existing in the aforementioned patents, details of which are set forth hereinafter.

SUMMARY OF THE INVENTION

It is among the principal objects of the present invention to provide one embodiment of display rack for eyeglasses which is preferably formed from inexpensive cardboard and initially is in a flat condition comprising two overlying plies which are foldably connected together, said overlying plies or panels having certain fold lines formed therein to render the display rack capable of quickly being set up from flat condition into triangular arrangement in cross-section of three connected panels which selectively may be positioned either vertically and thereby hold a limited number of eyeglasses in a vertical row thereon, or disposed horizontally with one of the panels sloping upward and rearward, and arranged to hold and display a similar limited number of eyeglasses in an attractive and compact manner.

Another object of the invention relative to said embodiment is to form the panel arrangement to provide a series of notches along one folded edge of said panels when disposed in operative position for purposes of receiving the nose bridges of eyeglasses and suitable openings are provided in the panels to receive the temple bars of eyeglasses when in the vertical position, whereas in the horizontal position, suitable openings are provided in one of the panels to receive the temple bars of eyeglasses and thus, secure the eyeglasses in adequate supporting manner upon the sloping panel in a row parallel to the opposite edges of the sloping panel.

A further object of the invention relative to said embodiment is to provide suitable channel members which receive the opposite edges of certain of the panels which are folded from portions of the main, overlying panels and disposed in planar relationship to constitute the third panel of the triangular configurations, additional short channel members also being provided to secure narrow edge panels in abutting relationship, which narrow portions extend outwardly from the apex of two of the triangularly arranged panels and said narrow panels contain the notches which receive and support the nose bridges of eyeglasses.

Another principal object of the invention is to provide another embodiment of display rack for eyeglasses which is triangular in cross-section but is formed rigidly, as distinguished from being collapsible, the preferred material being plastic sheet stock of uniform thickness and width, the sheet being bent along transverse lines to dispose the same into the aforementioned triangular shape, otherwise the eyeglass holding features are similar to those of the embodiment described above.

Details of the foregoing objects and of the invention, as well as other objects thereof, are set forth in the following specification and illustrated in the accompanying drawings comprising a part thereof.

BRIEF DESCRIPTION OF THE DRAWINGS

FIG. 1 is a somewhat exploded view showing a cardboard blank from which the display rack of the first embodiment is formed, certain areas thereon being added to indicate glue surfaces and the figure also shows adjacent opposite edges of the blank channel members which are employed to maintain certain folded portions of the panels in planar relationship.

FIG. 2 is an edge view of the blank shown in FIG. 1 after the same has been folded in flat condition comprising two panels in overlying relationship.

FIG. 3 is a plan view of the flattened rack shown in FIG. 2.

FIG. 4 is a side elevation of the rack when the flattened form shown in FIGS. 2 and 3 has been expanded and set up into triangular relationship of the panels, said view illustrating the rack in its vertical position.

FIG. 5 is a top plan view of the set up rack shown in FIG. 4.

FIG. 6 is an enlarged end view of one of the channel members shown in FIGS. 1, 4 and 5, and illustrated on substantially larger scale than employed in said figures.

FIG. 7 is a fragmentary end portion of one of said channels as shown in FIG. 6.

DETAILED DESCRIPTION

Figure 9:
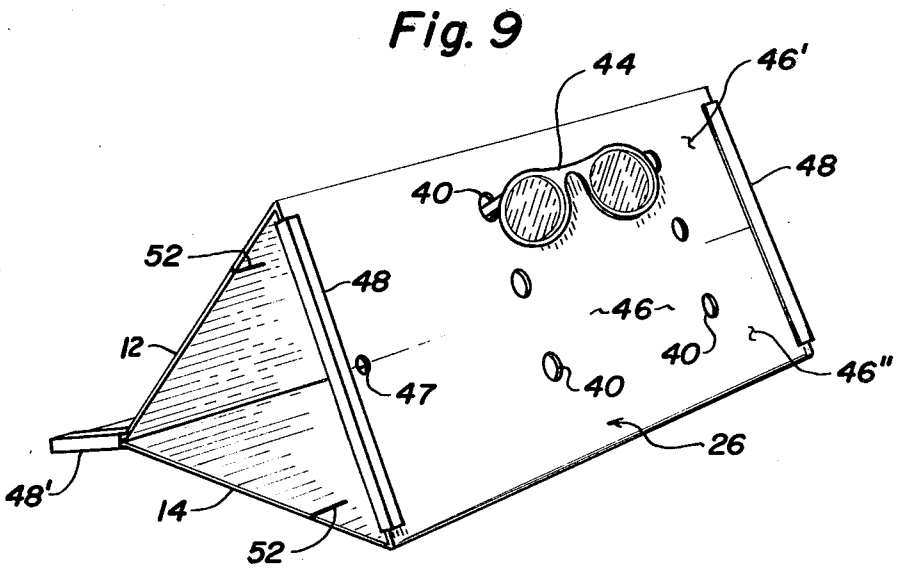
FIG. 9 is a perspective view isometrically illustrating the display rack in horizontal position for purposes of supporting and displaying a limited number of eyeglasses in compact relationship, one of the same being shown in exemplary manner in said figure and illustrating an alternate use of said rack from that shown in FIG. 8.

The basic essential features of one embodiment of the present invention, as shown in FIGS. 1–9, comprise the blank 10 which consists of a plurality of similar panels 12 and 14 between which a pair of narrow edge portions 16 and 18 of said panels are connected by foldable scorelines 20 and 22 respectively to the similar panels 12 and 14, the narrow panels also being connected by another foldable scoreline 24. Also foldably connected to the opposite end of panel 14 from that to which the narrow edge portion 18 is connected, is a third panel 26, which is connected to the panel 14 by still another foldable scoreline 28, and the opposite edge of panel 26 has a very narrow strip 30 foldably connected thereto along scoreline 32.

The similar panels 12 and 14 may be considered a first and second panel and each of them has a similar row of U-shaped incisions 34, and the narrow edge portions 16 and 18 also have a row of openings 36 therein which extend similar even distances into said edge portions from the central scoreline 24, said openings forming the notches 38 shown in FIG. 3, for purposes of receiving nose bridges of eyeglasses to support the same. The panel 26 also has two rows of similar temple-receiving apertures 40 therein. The incisions 34 comprise tongues which, when flexed or punched from the planes of panels 12 and 14 form apertures in said panels to receive temples of eyeglasses.

Figure 8:
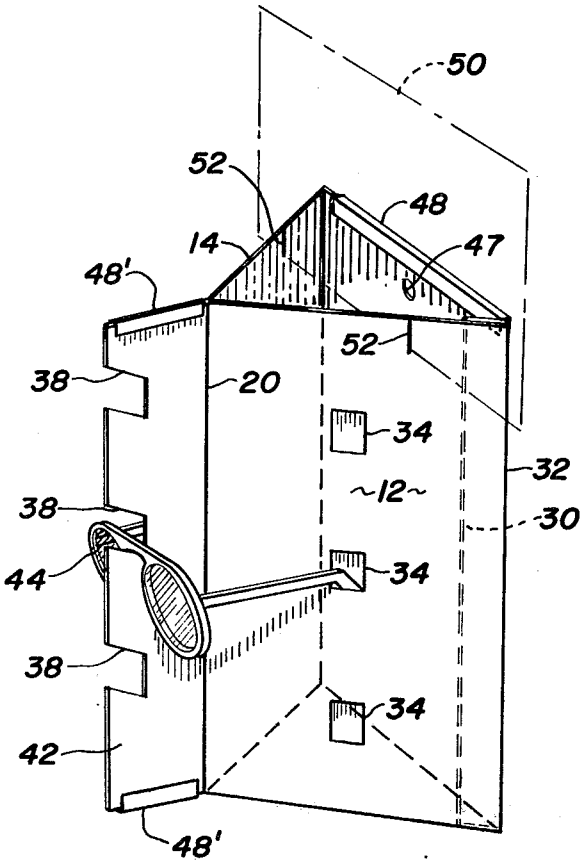
FIG. 8 is a perspective view of a rack disposed isometrically in vertical position and supporting on exemplary pair of eyeglasses, the upper end thereof having slots to receive a display card illustrated in phantom.

The blank 10, after being punched and incised to form the various apertures and incisions therein, is folded along the scoreline 24 after glue has been affixed to the upper surfaces of narrow edge portions 16 and 18. When the narrow edge portions 16 and 18 adhered to each other, as shown in FIG. 2, they comprise a stiff rib 42 in which the openings 36 become the notches 38, and it will be seen from FIG. 3 that said notches preferably slope inwardly and downwardly a limited amount to provide effective means for receiving the nose bridges of eyeglasses 44, as shown in FIG. 8, for example, with respect to a single exemplary pair of eyeglasses. The scorelines 22 essentially are subjected only to limited folding.

The panel 26 is provided midway between the fold lines 28 and 32 with a further fold line 46 and, thereby, panel 26 comprises a pair of similar supplemental panels 46′ and 46″. A hole 47 by which the display rack may be suspended from a hook or nail projecting from a wall also is provided in the third panel 26 in alignment with the fold line 46, as shown in FIG. 1. The display rack initially is in the flat condition shown in the exemplary manner in FIGS. 2 and 3. In these figures, it will be seen that the third panel 26 actually is folded upon itself, as shown best in FIG. 2, along the fold line 46, and the narrow strip 30 along the terminal end of panel 26 is glued to and underlies the terminal edge of panel 12, as also shown in FIG. 2. Thus, panel 26 is a compound panel comprising said supplemental panels 46′ and 46″. Also, referring to FIG. 2, it will be seen that actually the folded display rack comprises two overlying composite panels of equal width and length, the upper one as viewed in FIG. 2 consisting of narrow edge portion 16, first panel 12 and the supplemental panel 46″ comprising half of the third panel 26, whereas the lower composite panel consists of narrow edge portion 18, second panel 14, and supplemental panel 46′ comprising one-half of third panel 26.

To set up the display rack from the flat condition thereof shown in FIGS. 2 and 3 to the triangular arrangement shown, for example, in plan view in FIG. 5, the aforementioned composite upper and lower flat panels referred to above are pressed from opposite edges, along fold lines 24 and 46, which results in the halves 46′ and 46″ of the third panel 26 being hinged along scorelines 28 and 32 in order to dispose said halves in planar arrangement, as shown in FIGS. 4 and 5. To retain the planar arrangement of panel 26, supplemental means, preferably comprising elongated channels 48, are extended along the opposite edges of the flattened and planar panel 26. The channels may be formed from any suitable material, such as appropriate plastics, whereby the channels are relatively stiff but the opposite walls are adapted to be flexed a limited amount in order to receive and closely grip the edges of the panel 26 therebetween. Also, preferably, in addition to the adhesive or glue which retains the narrow edge portions 16 and 18 in fixed, overlying relationship, the present invention also additionally contemplates the use of short channels 48′ which are substantially as long as the stiff rib 42 and are disposed upon the opposite ends thereof as shown in FIG. 4.

Referring to FIGS. 8 and 9 wherein the intended uses of the display rack are illustrated in exemplary manner, it will be seen that in FIG. 8, the triangular display rack is supported upon one end upon any suitable horizontal surface, or may be supported from a hook or nail which is received through the hole 47. The eyeglasses 44 are disposed with the nose bridges in the notches 38 and the temple bars are inserted through the openings formed by depressing the tongues which are formed by the incisions 34 and projecting the temple bars therethrough as shown, for example, in FIG. 8. If, however, it is desired to display the rack in horizontal position, as shown in FIG. 9, it is only necessary to dispose the panel 14, for example, upon a flat surface, in which event, the eyeglasses 44 are mounted upon the third panel 26 by extending the temple bars through the holes or apertures 40 until the eyeglasses substantially rest against the outer surface of said panel 26.

Under certain circumstances, it may be desired to utilize a suitable placard or display card 50, shown in phantom in FIG. 8, in relation to the eyeglasses and the supporting rack. To support the card, especially when the rack is in vertical position as shown in FIG. 8, a pair of slots 52 are formed in the upper edges of the similar panels 12 and 14 to receive the display card 50.

Figure 10:
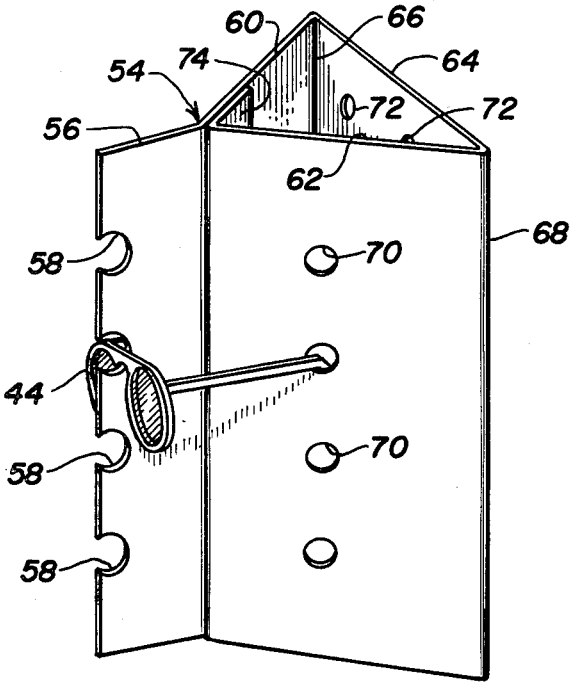
FIG. 10 is a perspective view of another embodiment of display rack embodying the invention shown in a position similar to that of the embodiment of rack shown in FIG. 8.
Figure 11:
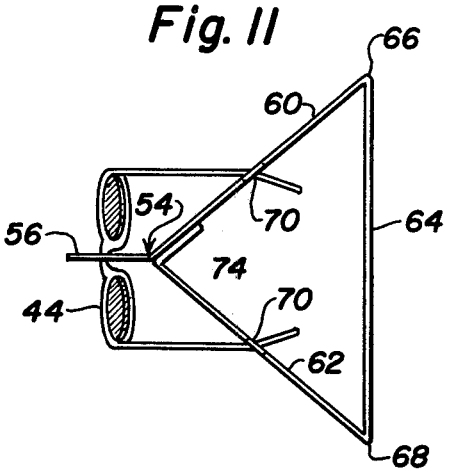
FIG. 11 is a top plan view of the display rack shown in FIG. 10.
Figure 12:
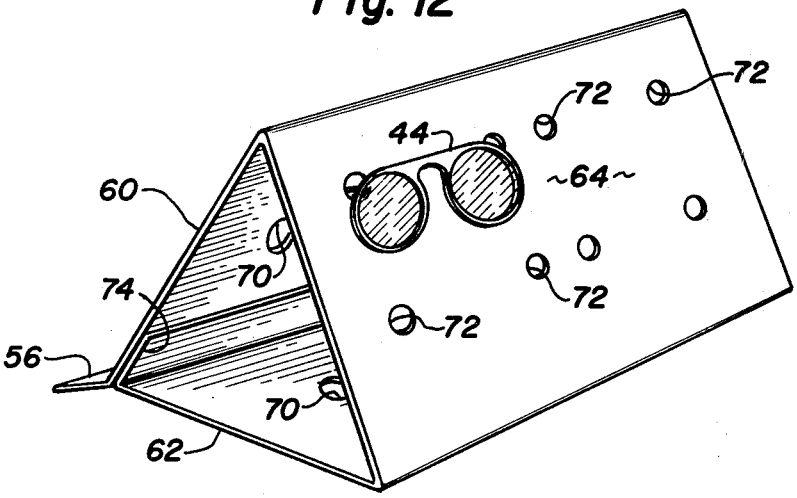
FIG. 12 is a perspective view of said another embodiment of display rack shown in FIGS. 10 and 11 but illustrated in the horizontal alternate position of the rack from that shown in FIG. 10.

The present invention also contemplates a second embodiment which is illustrated in FIGS. 10–12 of the drawings, particularly under circumstances where it is not necessary to have the display rack folded in flat condition as in regard to the preceding embodiment illustrated in FIGS. 1–9. As shown in FIGS. 10–12, the embodiment of display rack shown therein may be formed from a rectangular sheet of stiff material which is readily foldable or bendable along lines transverse to the longitudinal dimension of the sheet. One type of material highly suitable for such purposes is plastics, in which, for example, the thickness may be of the order of ⅛ inch but without restriction to such dimension. The sheet may be suitably heated to fold the same to form an obtuse angle 54 to provide a relatively narrow, stiff rib 56 which corresponds in function to the rib 42 of the preceding embodiment. Said rib is provided with a plurality of notches 58 into which the nose bridges of eyeglasses are disposed for support.

The sheet of material also is folded in order to effect a triangular configuration, such as clearly shown in FIGS. 10–12, especially FIG. 11, in which eyeglasses 44 are shown in exemplary manner. The obtuse angle 54 also forms one of a pair of similar panels 60 and 62, which correspond to the panels 12 and 14 in the preceding embodiment, one of the edges of each of the panels 60 and 62 being connected by a third panel 64, the panels 60, 62 and 64 being formed by sharply folding the original sheet of material along fold lines 66 and 68 to form acute angles between the respective panels.

The panels 60 and 62 are provided with rows of apertures 70 which are spaced apart in accordance with the notches 58 on rib 56 for purposes of receiving the temples of eyeglass frames as shown in exemplary manner in FIG. 10. Also, the third panel 64 is provided with a plurality of pairs of apertures 72 for use in receiving the temples of eyeglass frames when the display rack is arranged horizontally as shown in FIG. 12, as distinguished from the vertical arrangement shown in FIG. 10.

One edge of panel 62 is provided with a narrow portion 74 bent at an acute angle thereto which abuts and is connected to the adjacent surface of panel 60 at the angle 54 by any suitable means, such as cement. The resulting display rack is rugged and rigid.

From the foregoing, it will be seen that the present invention provides several embodiments of inexpensive, but highly useful and practical display cards, one of which may be initially disposed in flat condition for storage and distribution until ready for use and then it may quickly be disposed in operative position in which the various panels are arranged in triangular configuration, as shown in FIGS. 5, 8 and 9. Another embodiment is rigid. One of the outstanding features of the racks is that they may be used in a plurality of positions, selectively, as shown in exemplary manner in FIGS. 8 and 9.

The foregoing description illustrates preferred embodiments of the invention. However, concepts employed may, based upon such description, be employed in other embodiments without departing from the scope of the invention. Accordingly, the following claims are intended to protect the invention broadly, as well as the specific forms shown herein.

We claim:

1. A multi-position display rack for holding a plurality of eyeglasses of the type having temples and comprising in combination, a supporting frame of triangular configuration in cross-section composed of two similar panels of relatively rigid material disposed at an acute angle to each other and similar edges thereof engaging each other, a stiff rib connected to and extending along said similar edges and projecting outwardly from the junction thereof within a plane substantially bisecting said angle and said rib having a plurality of notches formed in the outer edge thereof in longitudinally spaced relationship to each other and adapted to receive the nose bridges of eyeglass frames, and a third panel of material similar to and extending between and connected to the edges of said similar panels which are opposite said engaged edges, said similar panels each having a similar row of temple-receiving apertures therein spaced apart similarly to the spacing of said notches in said rib, thereby to support a plurality of eyeglass frames when said rack is supported uprightly upon one end, and said third panel having two rows of spaced apertures therein of which opposite apertures in said rows respectively are adapted to receive temples of eyeglass frames and support the same when said rack is disposed sidewise upon a supporting surface and said third panel extends upward and rearward from one edge thereof.

2. The display rack according to claim 1 in which said panels and rib of said frame are formed from a unitary sheet of relatively rigid material of uniform width folded along transverse lines into said triangular configuration, one end of said sheet extending beyond said configuration to form said rib and the opposite end of said sheet being secured to the engagement of said similar edges of said similar panels with each other.

3. The display rack according to claim 2 in which said opposite end of said sheet has a narrow portion bent at an angle to the one of said similar panels with which it is integral and said portion overlying the similar edge of said other similar panel, and means affixing said portion to said similar edge of said other similar panel to render said frame rigid.

4. The display rack according to claim 1 in which said supporting frame comprises a pair of similar panels of relatively stiff sheet material having narrow edge portions adjacent similar edges of said panels and said portions being foldably connected along one edge and overlying each other to form said stiff rib and provided with notches formed in said folded edge to receive said nose bridges of eyeglasses, said similar panels being foldably connected to said narrow edge portions and respectively having similar rows of said temple-receiving apertures therein parallel to and intermediately between the opposite edges thereof and corresponding in number to said notches in said rib, said panels respectively being adapted to be folded from said rib away from each other to dispose the same at said acute angle to each other, and said third panel comprising a pair of supplemental panels of less width then said similar panels and foldably connected to each other along a central fold line and respectively connected to the edges of said similar panels opposite the edges thereof connected to said narrow portions forming said rib, said supplemental panels being adapted to be folded into a common plane, and means adapted to engage and hold said supplemental panels within said common plane, said supplemental panels having said two rows of temple-receiving apertures therein, whereby when said supplemental panels are positioned within said common plane all of the panels form said triangular display rack.

5. The display rack according to claim 4 in which one of said pairs of similar panels and one of said supplemental panels each jointly comprise an articulated panel and said articulated panels being hingedly connected at the outer edges thereof to permit said hingedly connected articulated panels to be disposed in flat overlying compact relationship for packaging and shipping.

6. The display rack according to claim 4 further including means securing said narrow edge portions of said similar panels in flat overlying connected relationship and maintaining the same in such connected position to form said stiff rib when said rack is set up in triangular configuration to render said display rack operable to receive and support eyeglasses as aforesaid.

7. The display rack according to claim 6 in which said means to secure said narrow edge portions in said flat overlying connected relationship comprise channel members no longer than the width of said narrow edge portions and respectively frictionally receiving the opposite ends of said narrow portions to secure said narrow edge portions as aforesaid.

8. The display rack according to claim 4 in which said means adapted to engage and hold said supplemental panels within said common plane comprise straight channel members adapted to be arranged along and clampingly receive the opposite side edges of said supplemental panels to maintain them in a plane as aforesaid.

9. The display rack according to claim 4 further including similar slots respectively extending similarly into one end edge of said similar panels and operable when said rack is set up and supported upon the opposite end edges of said panels to receive a display card extending between said panels and upwardly therefrom.

* * * * *